United States Patent [19]

Bennett et al.

[11] Patent Number: 5,023,979

[45] Date of Patent: Jun. 18, 1991

[54] FASTENER FOR GARMENTS

[76] Inventors: Robert B. Bennett, 352 E. Linden, Englewood, N.J. 07631; Vincent Hung, 65 Fairfield Rd., Parsippany, N.J. 07054; Ezra Sassoon, One Stanley Rd., White Plains, N.Y. 10605

[21] Appl. No.: 446,869

[22] Filed: Dec. 6, 1989

[51] Int. Cl.[5] ..... A44B 11/00

[52] U.S. Cl. ..... 24/68 R; 24/69 R; 2/237

[58] Field of Search ..... 24/68 R, 69 R, 69 ST, 24/71 ST, 589, 191, 698, 387; 2/221, 237

[56] References Cited

U.S. PATENT DOCUMENTS

| | | | |
|---|---|---|---|
| 2,738,561 | 3/1956 | Trilling et al. | 24/585 |
| 2,999,246 | 9/1961 | Rowan | 2/221 |
| 3,872,554 | 3/1975 | Wolfertz et al. | 24/68 R |
| 3,979,800 | 9/1976 | Masuda | 24/191 |
| 4,180,891 | 1/1980 | Stocker | 24/68 R |
| 4,193,136 | 3/1980 | Pierce | 2/237 |
| 4,226,008 | 10/1980 | Kramer | 2/237 |
| 4,545,096 | 10/1985 | Belter et al. | 24/68 R |
| 4,780,939 | 11/1988 | Belter et al. | 24/68 R |

FOREIGN PATENT DOCUMENTS

| | | | |
|---|---|---|---|
| 1359846 | 7/1974 | United Kingdom | 24/69 R |

*Primary Examiner*—Victor N. Sakran

*Attorney, Agent, or Firm*—Mitchell D. Bittman

[57] ABSTRACT

A fastener is assembled for a pair of overlapping members comprising a cloth tab secured at both ends to one of the members and a closure clasp having a bottom, a pair of pivot arms and a closure clasp arm pivotally mounted therein. The closure clasp bottom is secured to the other member to hide the entire closure clasp from view. The tab passes between the closure clasp arm and the bottom and the closure clasp is shiftable along the tab.

10 Claims, 1 Drawing Sheet

FASTENER FOR GARMENTS

BACKGROUND OF THE INVENTION

The present invention relates to a fastener for a pair of overlapping members for articles of clothing, valises, pockets or the like and more particularly to a fastener for waistbands on trousers, skirts or other garments.

Various type of fasteners or closures for clothing to adjust a waistband, for example of pants, without requiring time consuming sewing are well known in the art. One type of fastener as shown by U.S. Pat. No(s). 2,438,933, 2,825,111, 3,872,554, 4,180,891, 4,226,008, 4,545,096 and 4,780,939 employs a rail or track which is secured along its entire length to one clothing member with a buckle or slide for engaging the rail attached to the other clothing member. One common drawback of these devices is that if the rail or track broke, generally, the garment needed to be discarded because it was to difficult to remove and replace the rail. Another drawback was that the buckle or slide and or the rail was visible and was generally considered to be unattractive.

It is thus an object of this invention to provide a fastener for garment waistbands nd the like which is easy to use, readily serviceable and reliable.

It is a further object of this invention to provide a fastener in which the closure clasp and rail is hidden from view.

SUMMARY OF THE INVENTION

Briefly, this invention provides a fastener for a pair of overlapping members comprising a cloth tab secured at both ends to one of the members and a closure clasp having a bottom, a pair of pivot arms projecting from the bottom and a closure clasp arm pivotally mounted between the pivot arms. The closure clasp bottom is secured to the other member so that the entire closure clasp is between the two members and thus hidden from view. The tab passes through the closure clasp between the bottom and the closure clasp arm and the closure clasp is shiftable along the tab when the closure clasp arm is in the open position, and when the closure clasp arm is in the closed position the closure clasp arm securably engages the tab against the bottom preventing shifting of the closure clasp along the tab.

DETAILED DESCRIPTION OF THE INVENTION

Figure 1:
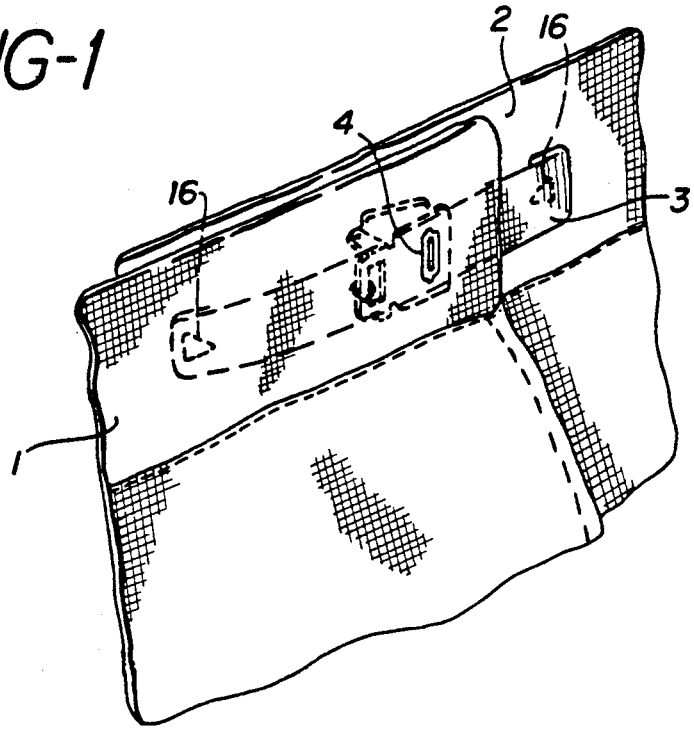
FIG. 1 shows the fastener of the invention applied to a trouser waist

The fastener of this invention is suitable for adjustably securing a pair of overlapping members for clothing, valises, pockets and the like, but more particularly for garment waistbands. FIG. 1 shows an overlying member 1 and an underlying member 2 of a trouser waistband being secured by the fastener of this invention with the only visible parts of the fastener being the tab 3 and the staple 4, which as shown in FIGS. 2 and 3 is used to secure the closure clasp 5 to the overlying member 1.

The tab 3 is longitudinally-extending and secured at both ends to one of the members, and as shown in the figures it is secured to the underlying member 2. In the embodiment of FIG. 2 the tab is of a durable cloth of sufficient strength and thickness to allow the closure clasp 5 to repeatedly and securably engage it without excessive wear or tearing. For example the cloth can be a non-woven cloth or fabric folded over a substance to achieve a thickness of about 0.2 to 0.5 cm. In the embodiment of FIG. 3, the tab 3 contains a rail 6 covered by a cloth 7. The rail 6 is used to provide added strength to the tab 3 with the rail 6 preferably containing a number of rests 8 or dent depressions for engaging the closure clasp 5. The rail can be of metal, or preferably plastic. The tab 3 is preferably secured to the member 2 by a sewed seam 16.

Figure 2:
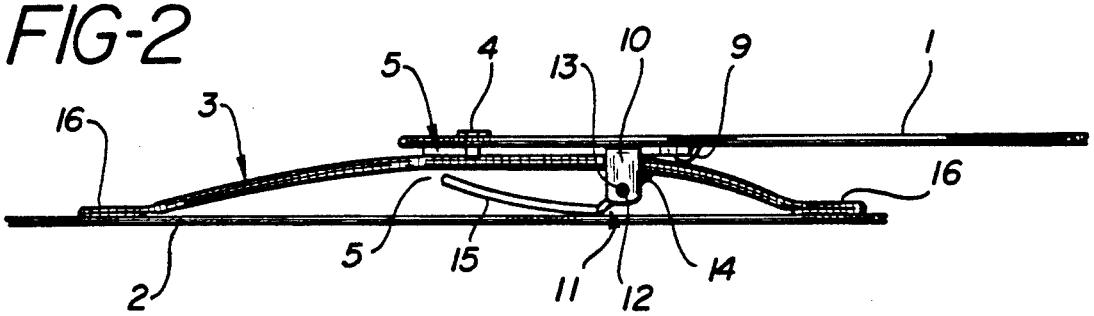
FIG. 2 shows a side view of the fastener of FIG. 1 with the closure clasp arm in a closed position.
Figure 3:
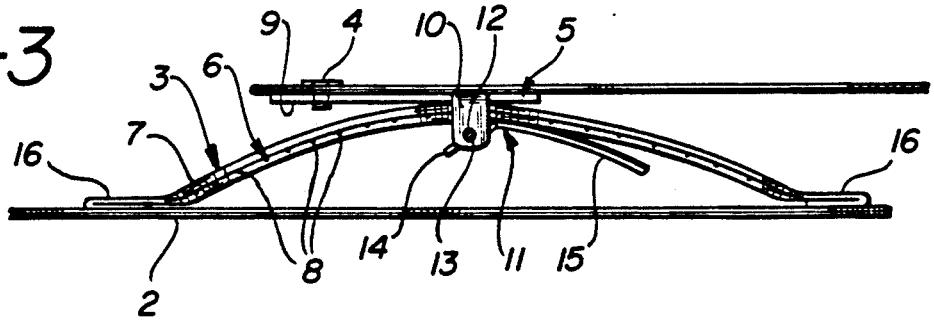
FIG. 3 shows a side view of the fastener of FIG. 1 with a different tab and with the closure clasp in an open position.
Figure 4:
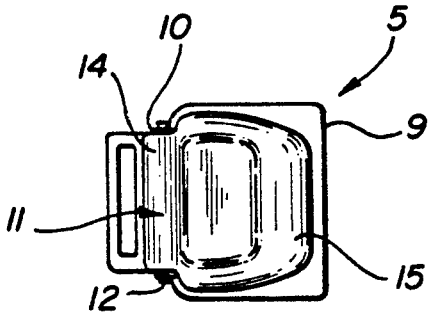
FIG. 4 shows a top view of the closure clasp with the closure clasp arm in a closed position.

As shown in FIGS. 2–4, the closure clasp 5 has a bottom 9, a pair of pivot arms 10 projecting from the bottom 9 and a closure clasp arm 11 pivotally mounted between the pivot arms 10. The closure clasp arm 11 is pivotally mounted by a pair of protrusions 12 from the closure clasp arm engaging holes 13 in the pair of pivot arms 10. Preferably the closure clasp arm 11 is bent into first and second portions 14 and 15; the first portion 14 which engages the tab when the closure clasp arm 11 is in the closed position, and the second portion 15 is used for manually moving the closure clasp arm 11 to and from the open and closed positions. The two portions 14 and 15 are preferably bent to an angle so that when in the closed position the second portion 15 lies flat against the members 1 and 2 to help conceal the fastener. The closure clasp 5 is constructed of a durable rigid plastic or preferably a metal.

The fastener is assembled by securing the bottom 9 of the closure clasp 5 to the clothing member 1 so that the entire closure clasp 5 is between the two members 1 and 2 and thus hidden from view. The tab 3 passes through the closure clasp 5 between the bottom 9 and the closure clasp arm 11. As shown in FIG. 3, when the closure clasp arm 11 is in an open position the closure clasp 5 is longitudinally shiftable along the tab 3. As shown in FIG. 2, when the closure clasp arm 11 is in the closed position the first portion 14 of the closure clasp arm 11 securably engages the tab 3 against the bottom 9 preventing longitudinal shifting of the closure clasp 5 along the tab 3. Preferably the closure clasp bottom 9 is secured to the member 1 by use of a staple 4 although other means, such as a sewed seam may be used.

Through use of the fastener of this invention, should the tab 3 become damaged, for example by washing or use, the tab can be easily replaced by removing the sewed seam 16 to remove the damaged tab and sewing on a functional tab. In addition, as shown in FIG. 1, the esthetics of the garment are enhanced by hiding the closure clasp and the rail, if used. The staple 4 can be made esthetically pleasing by placing an adornment on the visible portion.

What is claimed:

1. A hidden clasp fastener for a pair of overlapping members having an underlying member and an outer overlying member comprising:

a longitudinally-extending cloth tab secured at both free ends thereof to one of said overlapping members;

a closure clasp having a bottom, a pair of pivot arms projecting from said bottom and a closure clasp arm pivotally mounted between said pivot arms, said closure clasp bottom secured to the other of said overlapping members so that the closure clasp is hidden between the two overlapping members, wherein the cloth tab passes through the closure clasp between the bottom of said clasp and the closure clasp arm and the closure clasp is longitudinally shiftable along the cloth tab when the closure clasp arm is in an open position and when the closure clap arm is in a closed position the closure clasp arm securably engages the cloth tab against the bottom of said clasp preventing longitudinal shifting of the closure clasp along the cloth tab.

2. Fastener of claim 1 wherein the cloth tab is about 0.2 to 0.5 cm thick.

3. Fastener of claim 1 wherein the cloth of the tab is folded over and covers a rail having a row of rests which the closure clasp arm engages when in the closed position.

4. Fastener of claim 3 wherein said rail is plastic.

5. Fastener of claim 1 wherein the closure clasp bottom is secured to the other of said members by a staple.

6. Fastener of claim 1 wherein the closure clasp bottom is secured to the other of said members by a sewed seam.

7. Fastener of claim 1 wherein the closure clasp arm is bent into a first and second portion wherein the firs portion engages the tab when in the closed position and the second portion is used for manually moving the closure clasp arm to and from the open position and the closed position.

8. Fastener of claim 7 wherein the closure clasp is made of metal.

9. Fastener of claim 1 wherein the tab is secured to said member by a sewed seam.

10. Fastener of claim 1, wherein the overlapping members are a waistband of a garment.

* * * * *